US006970673B2

(12) United States Patent
Amarakoon

(10) Patent No.: US 6,970,673 B2
(45) Date of Patent: Nov. 29, 2005

(54) HIGHLIGHT COLOR PRINTING MACHINE

(75) Inventor: Kiri B. Amarakoon, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 33 days.

(21) Appl. No.: 10/696,214

(22) Filed: Oct. 28, 2003

(65) Prior Publication Data

US 2005/0089348 A1 Apr. 28, 2005

(51) Int. Cl.[7] ..... G03G 15/01

(52) U.S. Cl. ..... 399/298; 347/115; 399/2; 399/296; 399/302

(58) Field of Search ..... 399/2, 159, 162, 399/296, 298, 302, 154, 110, 111, 112, 223; 358/1.4; 347/115, 117

(56) References Cited

U.S. PATENT DOCUMENTS

| | | | | |
|---|---|---|---|---|
| 3,121,006 A | | 2/1964 | Middleton et al. | 430/31 |
| 3,357,989 A | | 12/1967 | Byrne et al. | 540/122 |
| 3,442,781 A | | 5/1969 | Weinberger | 430/32 |
| 4,078,929 A | | 3/1978 | Gundlach | 438/42 |
| 4,286,033 A | | 8/1981 | Neyhart et al. | 430/58.6 |
| 4,291,110 A | | 9/1981 | Lee | 430/58.8 |
| 4,338,387 A | | 7/1982 | Hewitt | 430/57.8 |
| 4,415,639 A | | 11/1983 | Horgan | 430/57.3 |
| 4,913,348 A | | 4/1990 | Hays | 430/45 |
| 5,347,353 A | * | 9/1994 | Fletcher | 399/296 X |
| 5,715,505 A | * | 2/1998 | Tombs et al. | 399/298 X |
| 5,828,931 A | * | 10/1998 | May et al. | 430/57.1 |
| 5,926,679 A | * | 7/1999 | May et al. | 399/296 |
| 6,493,533 B1 | * | 12/2002 | Munakata | 399/302 X |

FOREIGN PATENT DOCUMENTS

| | | | |
|---|---|---|---|
| JP | 54-059150 A | * | 5/1979 |
| JP | 62-115479 A | * | 5/1987 |

* cited by examiner

*Primary Examiner*—Sophia S. Chen
(74) *Attorney, Agent, or Firm*—Lloyd F. Bean, II

(57) ABSTRACT

An electrographic printing machine including: a first photoconductive member; an imaging device for recording a first latent image on the first photoconductive member to form a first developed image; a first developer unit for developing the first latent image; a second photoconductive member, closely adjacent to the first photoconductive member in a transfer region; a second imaging device for recording a second latent image on the second photoconductive member; a second developer unit for developing the second latent image to form a second developed image; a first transfer station for transferring the second developed image on the second photoconductive member to the first photoconductive member; and a second transfer station for transferring developed images on the first photoconductive member to a recording substrate.

12 Claims, 4 Drawing Sheets

HIGHLIGHT COLOR PRINTING MACHINE

Reference is made to commonly-assigned copending U.S. patent application Ser. No. 10/696,212, filed herewith, entitled "Photoreceptor for Highlight Color Printing Machine," by Kiri Amarakoon, the disclosure of which is incorporated herein.

This invention relates generally to the rendering of latent electrostatic images visible using multiple colors of dry toner or developer and, more particularly, to creating highlight color and/or custom color images on an image receiver.

The invention can be utilized in such imaging technologies as xerography and ionography. In the practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation. This charge pattern is made visible by developing it with toner. The toner is generally an electrically charged, colored powder which adheres to the charge pattern by electrostatic attraction. The developed image is then fixed to the imaging surface or is transferred to a receiving substrate such as plain paper to which it is fixed by suitable fusing techniques. Recent developments in the art of xerography have been directed to highlight color imaging wherein at least two colored images are produced in a single pass. Several concepts for xerographic single pass highlight color (SPHLC) imaging systems are known. One of the more elegant and practical of these is tri-level imaging. In general in tri-level imaging, two different latent images are formed in one imaging step, with a white or background level at an intermediate voltage. With the development bias near the white level in either case, one image is charged-area developed while the other is discharged-area developed. This is accomplished by using positive toner for one color and negative toner for the other, in separate housings. Typically one toner is black and the other is a preferred color for highlighting.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness. In tri-level xerography, the xerographic contrast on the charge retentive surface or photoreceptor is divided three rather than two ways as is the case in conventional xerography. The photoreceptor is charged, typically to 900 volts. It is exposed imagewise, such that one image corresponding to charged image areas (which are subsequently developed by charged area development, i.e. CAD) stays at the full photoreceptor potential (V.sub.ddp or V.sub.cad, see FIGS. 1*a* and 1*b*). The other image is exposed to discharge the photoreceptor to its residual potential, i.e. V.sub.c or V.sub.dad (typically 100 volts) which corresponds to discharged area images that are subsequently developed by discharged-area development (DAD). The background areas are formed by exposing areas of the photoreceptor at V.sub.ddp to reduce the photoreceptor potential to halfway between the V.sub.cad and V.sub.dad potentials, (typically 500 volts) and is referred to as V.sub.w or V.sub.white. The CAD developer is typically biased about 100 volts closer to V.sub.cad than V.sub.white (about 600 volts), and the DAD developer system is biased about 100 volts closer to V.sub.dad than V.sub.white (about 400 volts). U.S. Pat. No. 4,913,348 granted to Dan A. Hays on Apr. 3, 1990 discloses an imaging apparatus wherein an electrostatic charge pattern is formed on a charge retentive surface. The charge pattern comprises charged image areas and discharged background areas. The fully charged image areas are at a voltage level of approximately −500 volts and the background is at a voltage level of approximately −100 volts. A spatial portion of the image area is used to form a first image with a narrow development zone while other spatial portions are used to form other images which are distinct from the first image in some physical property such as color or magnetic state. The development is rapidly turned on and off by a combination of AC and DC electrical switching. Thus, high spatial resolution multi-color development in the process direction can be obtained in a single pass of the charge retentive surface through the processing stations of a copying or printing apparatus. Also, since the voltages representing all images are at the same voltage polarity unipolar toner can be employed. In order to effect development of all images with a unipolar toner, each of the development system structures is capable of selective actuation without physical movement.

There is an increasing interest in single pass custom color (SPCC). Custom color differs from highlight color in two ways. First, it generally refers to a very specific color, "customized" for a given customer or user. The customer typically will be very concerned that the hue meets his specifications. Thus, the specific color toner should be formulated in the factory rather than created by the process, as it is in process color systems, unless there is extremely good process control. Secondly, it is typically used to provide an instant identification of the document with the customer and with the customer's advertising. It would not be the color desired for normal highlighting. Ideally, it is desirable to provide SPHLC and SPCC on the same document, that is, to enable documents to be printed with both a custom color and a highlight color, along with black, in only one pass through the system. Unfortunately, tri-level is available only for two colors corresponding to the two polarities of electrical charge.

There is provided an electrographic printing machine comprising: a first photoconductive member; an imaging device for recording a first latent image on said first photoconductive member to form a first developed image; a first developer unit for developing said first latent image; a second photoconductive member, closely adjacent to said first photoconductive member in a transfer region; a second imaging device for recording a second latent image on said second photoconductive member; a second developer unit for developing said second latent image to form a second developed image; a first transfer station for transferring said second developed image on said second photoconductive member to said first photoconductive member; and a second transfer station for transferring developed images on said first photoconductive member to a recording substrate.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Figure 1:
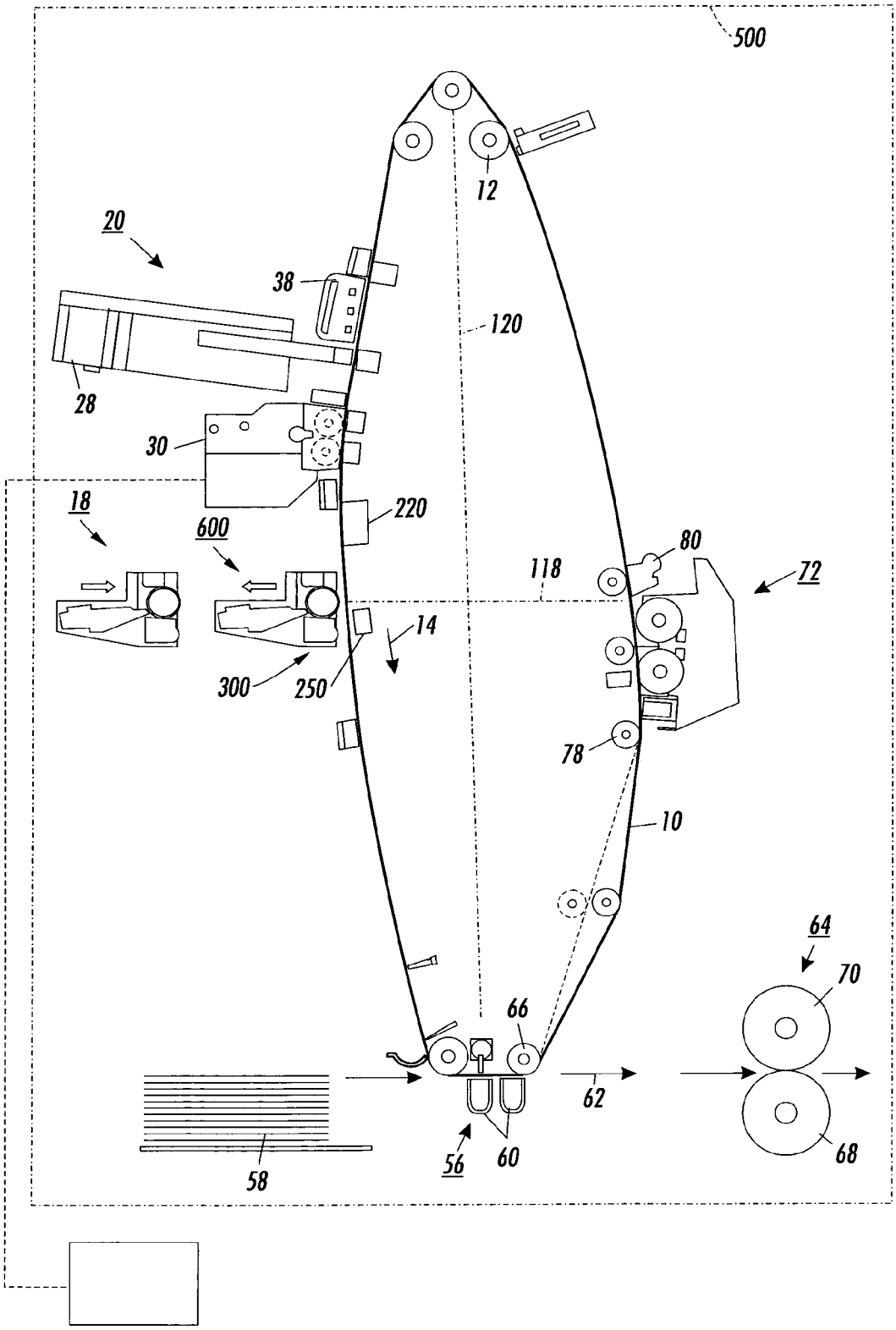
FIG. 1 is a single pass multi-color printing machine.

Referring now to the drawings, there is shown a single pass multi-color printing machine in FIG. 1. This printing machine employs the following components: a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 118. The major and minor axes 120 and 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 18 and 20, respectively. Initially, photoconductive belt 10 passes through image recording station 16. Image recording station 16 includes a charging device and an exposure device. The charging device includes a corona generator 38 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 is a module which is replaceable with identical module 600 having a different color marking particles therein. Module includes photoconductive drum 200, charging device, an exposure device, and drum cleaning device. The charging device includes a corona generator 232 which charges the exterior surface of photoconductive drum 200 to a relatively high, substantially uniform potential. The exposure device includes a ROS 234 which illuminates the charged portion of the exterior surface of photoconductive drum 200 selectively to record a second electrostatic latent image thereon. This second electrostatic latent image corresponds to the regions to be developed with custom toner particles. This second electrostatic latent image is now advanced to the developer unit 236.

Developer unit 236 deposits HLC toner particles on the electrostatic latent image. In this way, a custom toner powder image is formed on the exterior surface of photoconductive drum 200. After the custom toner powder image has been developed on the exterior surface of photoconductive drum 200, photoconductive belt 10 continues to advance in the direction of arrow 14 to conditioning station 220.

Conditioning station 220 enables a conventional photoconductive belt 10 to be used as an intermediate transfer belt so that a second toned color image can be transferred to produce a black and a HLC toned image on the belt that can be transferred to media. Alternatively, the use of a belt with a segmented ground plane with disclosed in US Publication No. 20050089344 hereby incorporated by reference. That photoreceptor allows for field tailoring in a desired area (i.e. in an image frame) with use of a biasing pad 400 which addresses the segment ground plane with out effecting the fields on the remaining portion of the photoreceptor belt. Preferably, a conventional photoreceptor can be employed in which field tailoring can be accomplished by employing a discharge lamp on the back of the belt and biasing the drum module with an ungrounded drum marker module. Both these schemes will require some electrostatic tailoring at the transfer point as shown in FIG. 2.

Figure 2:
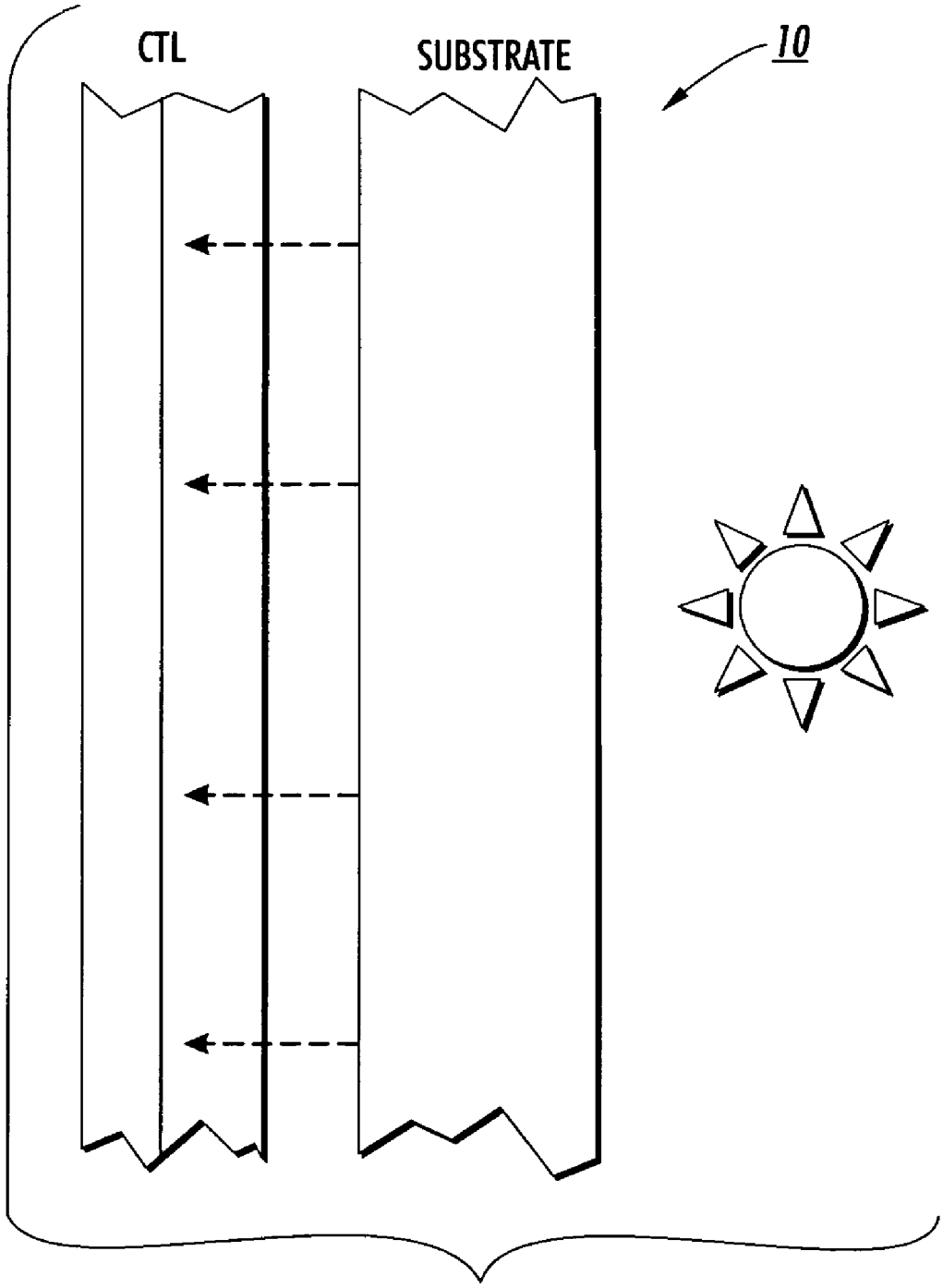
FIG. 2 illustrates field tailoring in the photoreceptor.
Figure 3:
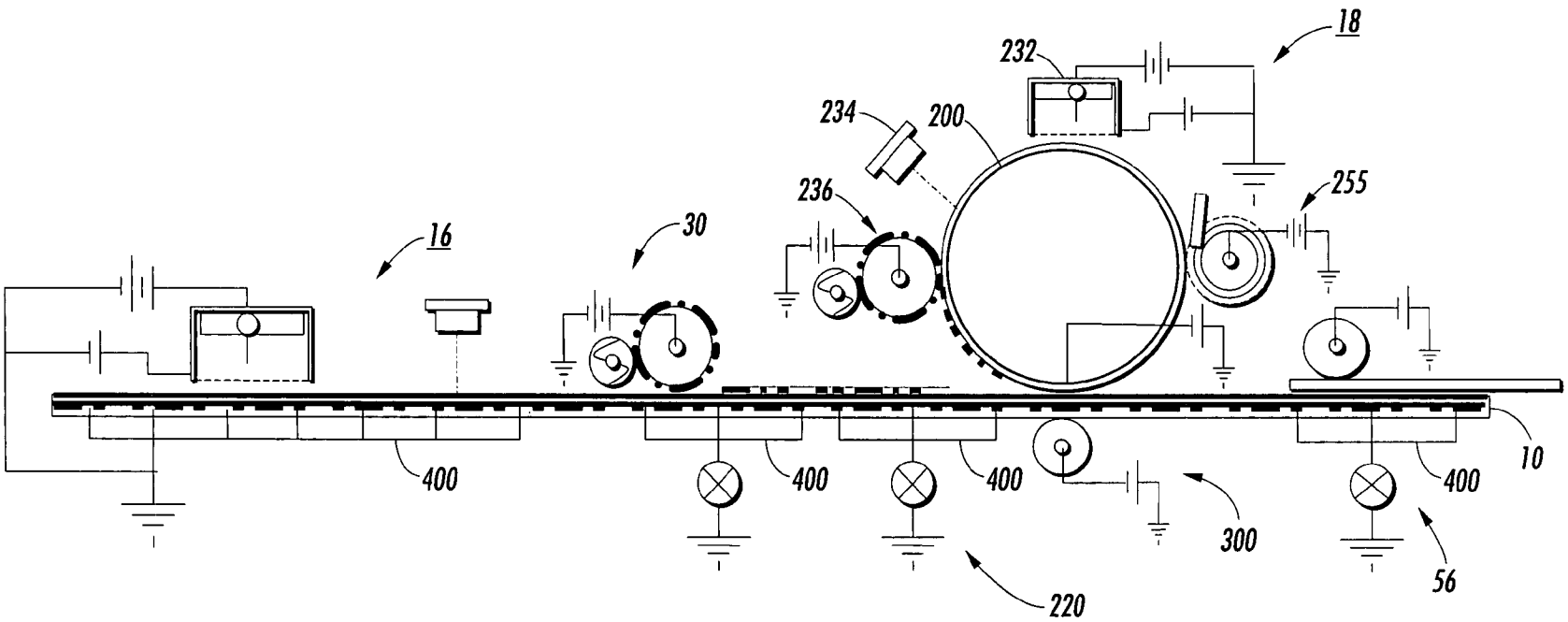
FIG. 3 is a process schematic of the invention.

The conditioning lamp shown in FIG. 2 enables trapped field and surface charge from the image background and toner to be to be made uniform causing the +ve charge to come to the surface.

At transfer station 300, the developed image on drum 200 is transferred to belt 10. The developed image can be transfer in the same image frame as the developed image on belt to produce a HCL image or in an adjacent image frame. Transfer station 300 include a bias transfer member 250 which applies a bias to transfer the image from the drum 200 to belt 10 when using the segmented belt. Thereafter, photoconductive belt 10 advances the HLC toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multicolor image thereon. After fusing, the finished sheet is discharged to a finishing station where the sheets are compiled and formed into sets which may be bound to one another. These sets are then advanced to a catch tray for subsequent removal therefrom by the printing machine operator.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom. Similarly, residual toner particles remain adhering to the exterior surface of photoconductive drum 200 are clean by cleaning device 255.

Figure 4:
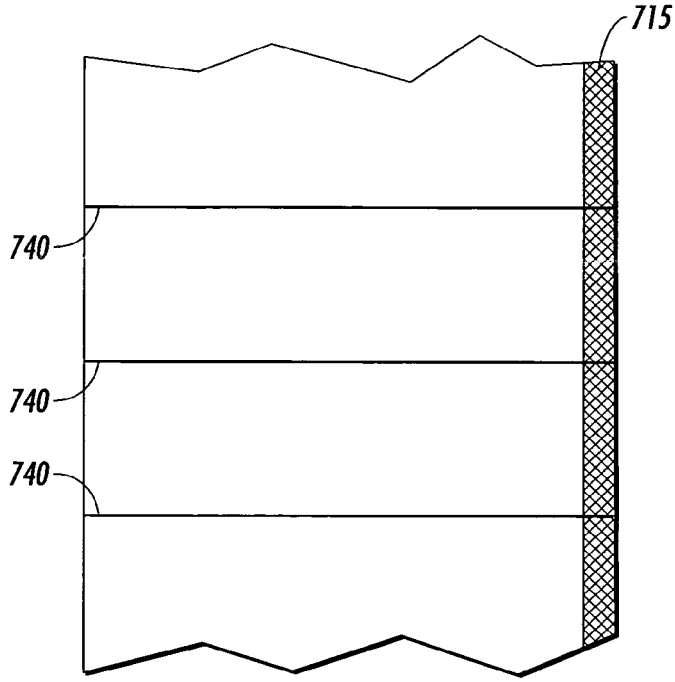
FIGS. 4 and 5 illustrate a photoreceptor employed within the present invention.
Figure 5:
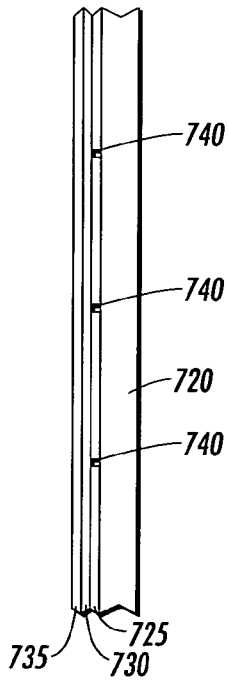

Now referring to FIGS. 4 and 5, focusing photoreceptor belt 10 can be made with a layer of conductive material deposited on an insulating substrate 720 and the other active layers are deposited on top of this layer. The active layers are charge transport layer 735, charge generation layer 730. The conductive layer 725 is segmented and is used as the ground plane for electrostatics. The grounding layer is connected to the system ground or an applied bias using a pad 400.

The ground plane 725 is to segment by including insulating separation lines 740 at regular intervals narrow enough so as not to cause image quality problems. Insulating lines less than 10 to 20 microns are acceptable to maintain IQ requirements since the subsequent layers are continuous and the width of the gaps are small compared to thickness of the transport layer (CTL).

The segmented or addressable areas of the conductive plane can now be used to ground the photoreceptor during charging, exposure, etc, and connect the conductive layer to other potentials during development, transfer, cleaning, etc. This will also enhance the capabilities of Tri-level HLC and other options for High Light Color.

FIG. 4 shows the proposed PR belt with narrow 10 to 20 micron lines segmenting the conductive layer. These can be manufactured in several ways. For example by masking the insulating substrate during deposition of the conductive layer or by etching an aluminized substrate prior to coating the other layers. Others may be possible. This is well known technology in semiconductor and electronic component manufacturing.

The segmented conductive segments are connected to the external sources via a segmented strip 715 composed of conductive materials as practiced in current photoconductive belts. The segmented belt can be used to enhance performance of the system by selectively tailoring the field in Photoreceptor interface by addressing the conductive layer for each function. For example, during charging and imaging conductive layer is grounded. During development, transfer, cleaning, etc. the conductive layer may be grounded or a potential applied to the conductive layer.

The following is a description of layers, and the formation thereof, which may be employed in photoreceptors in accordance with the present invention. Other arrangements may also be used. The photoreceptors in accordance with the present invention are preferably prepared by first providing a substrate. The substrate may be opaque or substantially transparent and may comprise any of numerous suitable materials having the required mechanical properties. The substrate may comprise a layer of electrically conductive material such as an inorganic or organic composition. The substrate is preferably flexible and may have any number of different configurations such as, for example, a sheet, a scroll, an endless flexible belt, and the like. Preferably, the substrate is in the form of an endless flexible belt. As electrically non-conducting materials, there may be employed various resins known for this purpose, including polyesters, polycarbonates, polyamides, polyurethanes, and the like.

The substrate preferably comprises a commercially available biaxially oriented polyester known as MYLAR®, available from E.I. du Pont de Nemours & Co., MELINEX®, available from ICI Americas Inc. or HOSTAPHAN®, available from American Hoechst Corporation. Other materials which the substrate may comprise include polymeric materials such as polyvinyl fluoride, available as TEDLAR® from E.I. du Pont de Nemours & Co., and polyimides, available as KAPTON® from E.I. du Pont de Nemours & Co.

The photoreceptor can also be coated on an insulating plastic drum providing that a conducting ground plane was coated on its surface. When a conductive substrate is employed, any suitable conductive material may be used. For example, the conductive material may include metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or their pyrolysis and molecular doped products, charge transfer complexes, polyphenylsilane and molecular doped products from polyphenylsilane.

A conducting metal drum made from a material such as aluminum can be used, as well as a conducting plastic drum. The preferred thickness of the substrate depends on numerous factors, including mechanical performance required and economic considerations. The thickness of the substrate is typically within the range of from about 65 micrometers to about 150 micrometers, preferably from about 75 micrometers to about 125 micrometers for optimum flexibility and minimum induced surface bending stress when cycled around small diameter rollers, e.g., 19 millimeter diameter rollers.

The substrate for a flexible belt may be of substantial thickness, for example, over 200 micrometers, or of minimum thickness, for example, less than 50 micrometers, provided there are no adverse effects on the final photoconductive device. The ground plane may be applied by known coating techniques, such as solution coating, vapor depositing and sputtering. A preferred method of applying an electrically conductive ground plane is by vacuum deposition. Other suitable methods may also be used. Preferred thicknesses of the ground plane are within a substantially wide range, depending on the optical transparency and flexibility desired for the electrophotoconductive member.

Accordingly, for a flexible photoresponsive imaging device, the thickness of the conductive layer is preferably between about 20 Angstroms and about 750 Angstroms, more preferably from about 50 Angstroms to about 200 Angstroms, for an optimum combination of electrical conductivity, flexibility and light transmission. However, the ground plane can be opaque and front erase employed. A blocking layer may be positioned over the conductive layer. Nevertheless, if desired, a charge blocking layer may be employed in the present invention and may be applied over the conductive layer.

For the inverted photoreceptor structure, the hole blocking layer 25 prevents holes from the charging surface from migrating through the photoreceptor to the ground plane, thus destroying the latent image. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like as disclosed in U.S. Pat. Nos. 4,338,387, 4,286,033 and 4,291,110. Other suitable materials may be used.

The charge generation layer in accordance with the present invention comprises charge generation film forming polymer and photogenerating particles. The charge generation layer of some embodiments in accordance with the present invention further comprises one or more dopant comprising organic molecules containing basic electron donor or proton acceptor groups. Suitable charge generation film forming polymers include those described, for example, in U.S. Pat. No. 3,121,006. The film forming polymer preferably adheres well to the layer on which the charge generation layer is applied, preferably dissolves in a solvent which also dissolves any adjacent adhesive layer (if one is employed) and preferably is miscible with the copolyester of any adjacent adhesive layer (if one is employed) to form a polymer blend zone. For example, suitable film forming materials include polyvinylcarbazole (PVK), phenoxy resin, polystyrene, polycarbonate resin, such as those available under the tradenames Vitel PE-100 (available from Goodyear), Lexan 141, and Lexan 145 (available from General Electric).

Other suitable materials may be used. Examples of materials which are suitable for use as photogenerating particles include, for example, particles comprising amides of perylene and perinone, chalcogens of selenium II–VI or tellurium III–V compounds, amorphous selenium, trigonal selenium, and selenium alloys such as, for example, selenium-tellurium, selenium-telluriumarsenic, selenium arsenide, and phthalocyanine pigments such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from E.I. du Pont de Nemours & Co. under the Tradenames Monastral Red, Monastral Violet and Monastral Red Y, dibromo anthanthrone pigments such as those available under the tradenames Vat Orange 1 and Vat Orange 3, benzimidazole perylene, substituted 2,4-diamino-triazines disclosed in U.S. Pat. No. 3,442,781, polynuclear aromatic quinones available from Allied Chemical Corporation under the Tradenames Indofast Double Scarlet, Indofast Violet Lake B, Indofast Brilliant Scarlet and Indofast Orange, and the like.

Particularly preferred photogenerating particles include particles comprising vanadyl phthalocyanine, trigonal selenium, and benzimidazole perylene. Multi-photogenerating layer compositions may be utilized where a photoconductive layer enhances or reduces the properties of the photogeneration layer. Examples of this type of configuration are described in U.S. Pat. No. 4,415,639. Other suitable photogeneration materials known in the art may also be utilized, if desired.

Charge generation layers comprising a photoconductive material such as vanadyl phthalocyanine, titanyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, titanyl phthalocyanine, metal free phthalocyanine and tellurium alloys are also preferred because these materials provide the additional benefit of being sensitive to infra-red. The preferred photoconductive materials for use in the charge generation layers are benzimidazole perylene, trigonal selenium and vanadyl phthalocyanine. The photogeneration layer in some embodiments in accordance with the present invention is applied over the conductive layer (or any charge blocking layer over the substrate) and the charge transport layer is applied over the photogeneration layer. The charge generation coating composition is applied by a very high quality lithographic printing or by a photo patterning and etching of a photoresist coated generation film.

The charge generation coating composition is then dried to remove the solvent. Drying of the deposited coating may be effected by any suitable conventional technique such as oven drying, infrared radiation drying, air drying and the like, to remove substantially all of the solvent utilized in applying the coating. The photogeneration layer of the invention is generally of a thickness within the range of from about 0.1 micrometer to about 5.0 micrometers, preferably from about 0.3 micrometer to about 3.0 micrometers. Thicknesses outside these ranges can be selected, providing the objectives of the present invention are achieved. The charge transport material is generally any suitable transparent organic polymeric or non-polymeric material capable of supporting the injection of photogenerated holes from the charge generation layer and allowing the transport of these holes through the layer to selectively discharge the surface charge.

The invention has been described in detail with particular reference to a preferred embodiment thereof, but it will be understood that variations and modifications can be effected within the spirit and scope of the invention as described hereinabove and as defined in the appended claims.

What is claimed is:

1. An electrographic printing machine comprising:

a first photoconductive member, said first photoconductive member includes an individual addressable segments for modifying electostatic fields in a transfer area;

an imaging device for recording a first latent image on said first photoconductive member;

a first developer unit for developing said first latent image;

a second photoconductive member, closely adjacent to said first photoconctuctive member in a transfer region;

a second imaging device for recording a second latent image on said second photoconductive member;

a second developer unit for developing said second latent image to form a second developed image;

a first transfer station for transferring said second developed image on said second photoconductive member to said first photoconductive member; and a second transfer station for transferring developed images on said first photoconductive member to a recording substrate.

2. The electrographic printing machine of claim 1, wherein said first transfer station includes a condition system for reducing electrostatic force on said first photoconductive member to improve transfer of said second developed image thereto.

3. The electrographic printing machine of claim 2, wherein said condition system includes a discharge device position before said first transfer station.

4. The electrographic printing machine of claim 1, wherein said first developer unit contains marking particle of a different color of said second developer unit.

5. The electrographic printing machine of claim 1, wherein said first transfer station transfers said second developed image in the same image frame as said first developed image on said first photoconductive member.

6. The electrographic printing machine of claim 1, further comprising a replaceable module including said second photoconductive member and said second developer unit, said replaceable module is replaceable with a second replaceable module.

7. An electrographic printing machine comprising:

a first photoconduotive member;

an imaging device for recording a first latent image on said first photoconductive member;

a first developer unit for developing said first latent image;

a second photoconductive member, closely adjacent to said first photoconductive member in a transfer region;

a second imaging device for recording a second latent image on said second photoconduotive member;

a second developer unit for developing said second latent image to form a second developed image;

a first transfer station for transferring said second developed image on said second photoconductive member to said first photoconductive member; and a second transfer station for transferring developed images on said first photoconductive member to a recording substrate, said first transfer station transfer said second developed image in an adjacent image frame as said first developed image on said first photoconductive member.

8. The electrographic printing machine of claim 7, wherein said first transfer station includes a condition system for reducing electrostatic force on said first photoconductive member to improve transfer of said second developed image thereto.

9. The electrographic printing machine of claim 8, wherein said condition system includes a discharge device position before said first transfer station.

10. The electrographic printing machine of claim 7, wherein said first developer unit contains marking particle of a different color of said second developer unit.

11. The electrographic printing machine of claim 7, wherein said first transfer station transfers said second developed image over said first developed image on said first photoconductive member.

12. The electrographic printing machine of claim 7, further comprising a replaceable module including said second photoconductive member and said second developer unit, said replaceable module is replaceable with a second replaceable module.

* * * * *